US006015395A

United States Patent [19]

Kautzky

[11] Patent Number: 6,015,395

[45] Date of Patent: Jan. 18, 2000

[54] LOWER BACK SUPPORT

[76] Inventor: Hans Kautzky, 284 Church St., West Chicago, Ill. 60185-2706

[21] Appl. No.: 09/036,445

[22] Filed: Mar. 6, 1998

[51] Int. Cl.[7] ..... A61H 1/02

[52] U.S. Cl. ..... 602/19; 602/20; 602/5

[58] Field of Search ..... 602/17–19, 20; 606/53–55, 59, 73

[56] References Cited

U.S. PATENT DOCUMENTS

| | | | |
|---|---|---|---|
| 4,518 | 5/1846 | Sullivan . | |
| 4,968 | 2/1847 | Knapp . | |
| 26,628 | 12/1859 | Taylor . | |
| 129,202 | 7/1872 | Zachos . | |
| 170,655 | 12/1875 | Allen . | |
| 888,490 | 5/1908 | Haas . | |
| 954,005 | 4/1910 | Roth . | |
| 1,614,641 | 1/1927 | Anderson . | |
| 2,187,323 | 1/1940 | Kelton et al. . | |
| 2,197,323 | 1/1940 | Kelton | 128/87 |
| 2,886,031 | 5/1959 | Robbins | 128/78 |
| 3,029,810 | 4/1962 | Martin . | |
| 3,351,053 | 11/1967 | Stuttle . | |
| 3,667,457 | 6/1972 | Zumaglini . | |
| 3,799,156 | 3/1974 | Gurkin . | |
| 3,827,429 | 8/1974 | Heikes . | |
| 4,896,659 | 1/1990 | Goldish . | |
| 4,996,978 | 3/1991 | Gingras | 128/78 |
| 5,224,924 | 7/1993 | Urso . | |
| 5,405,313 | 4/1995 | Albin | 602/19 |
| 5,538,499 | 7/1996 | Schwenn et al. . | |
| 5,651,764 | 7/1997 | Chiu | 602/19 X |
| 5,782,783 | 7/1998 | Young et al. | 602/20 |
| 5,885,286 | 3/1999 | Sherman et al. | 606/61 |

*Primary Examiner*—Richard J. Apley
*Assistant Examiner*—Jayne Saydah
*Attorney, Agent, or Firm*—Nilles & Nilles, S.C.

[57] ABSTRACT

A back support device has a pair of short crutches each having a shaft with an upper end and an armpit rest carried on the upper end. A pair of ball and socket connections each removably and pivotally support a lower end of each of the crutches. The lower ends of the crutches are each positioned adjacent one of a pair of pelvic bones of an individual and anchored at a fixed point either surgically or non-surgically. Each shaft extends upward from a respective one of the ball and socket connections to a respective one of the armpit rests. The lower ends of the crutches are free to rotate about the respective fixed points relative to the ball and socket connections according to movement of the individual. Unobstructed upper body movement is assured, while the vertical downward forces in the lower back vertebrae are reduced. The device may be hidden from view under a layer of clothing and permits standing, sitting, walking, running and stair climbing while keeping the hands free.

21 Claims, 1 Drawing Sheet

LOWER BACK SUPPORT

BACKGROUND OF THE INVENTION

This invention relates generally to support devices for the lower back, and more particularly to a lower back support which is either partially surgically implanted, or which is non-surgical and removable.

There are many elaborate back support devices which are known in the art. Examples of these types of devices are described in U.S. Pat. Nos. 129,202; 4,996,978; 5,224,924; 1,614,641; and 3,827429.

Many of these devices are intended to provide lower back relief by stretching or reducing the vertical load component on the lower back for individuals in the sitting position. These devices typically do not permit the individual to twist and turn or to bend forward or rearward when wearing the devices. Some of these devices are also intended for use by a standing person such as disclosed in U.S. Pat. No. 1,614,641. This device includes only a forward/rearward rotation which permits limited movement of the individual when wearing the device. This device includes low hanging belt receptacles which are unable to transmit the crutch forces to the top of the hip bulge or pelvic bone. Sitting down with such a device is also not possible. Additionally, many of these prior art devices are fairly elaborate such as disclosed in U.S. Pat. No. 3,827,429. This reference discloses several embodiments of a support bracket which is attached around the waist of an individual and extends over the individual's head. A harness is strapped under the individual's shoulders or chin to lift a portion of the person's torso to reduce stress on the lower back.

Lower back problems in many cases are caused by the fact that the lower 4 or 5 vertebrae provide all of the weight force support from the pelvic bridge upward and also most of the flexibility between the upper and lower torso of an individual. Further, the weight distribution of a person's upper torso relative to the lower back vertebrae is mostly distributed forward of the vertebrae. The back muscles are disposed rearward of the spine and must counteract the imbalance of weight distribution of the upper torso over the lower back vertebrae. Thus, when an individual carries excess weight in their arms, or as stored fat on their stomach, the excess weight throws off the center of gravity of the upper torso distributing most of the weight forward of the lower back pivot point. The back muscles must counteract such imbalance. The geometry of the lower back vertebrae and muscles causes a tenfold increase of forces exerted on the lower back relative to the increase weight. This causes damage to nerve passageways resulting in pain.

Another factor causing lower back pain is that over time our vertebrae and discs become worn, altered or otherwise damaged through use and abuse. The weight of the upper body pressing on the vertebrae when individuals are erect sitting or in a standing position causes back pain.

The only conventional way to relieve this type of back pain is to lie flat and remove the load on the vertebrae allowing the back to rest. Many of the known prior art devices are intended to temporarily alleviate load on the lower back and alleviate the compression forces on the vertebrae and disks. These devices typically are not intended to be used by an individual while they are active or ambulatory but merely intended to be used during periods of rest for temporary, short term pain alleviation. Additionally, many of these prior art devices are large, complicated to assemble, difficult to put on, are visibly obtrusive and are heavy adding weight to the individual.

SUMMARY OF THE INVENTION

The present invention is for a lower back support device which overcomes these and other disadvantages of the prior devices. One object of the present invention is to provide a lower back support which is light weight, simple in construction, and easy to use. Another object of the present invention is to provide a lower back support which may be worn by an individual while sitting, standing, walking, running, bending over, twisting or performing normal life activities. A further object of the present invention is to provide a lower back support which is unobtrusive and unnoticeable when being worn by an individual underneath an outer layer of clothing.

In one embodiment, a back support device of the invention has a pair of short crutches. Each of the crutches has a shaft with a lower end, an upper end, and an armpit rest carried on the upper end. The back support device also has a pair of connection members each removably and pivotally supporting the lower end of one of the crutches, one each adjacent each of the pelvic bones of an individual at a corresponding fixed point. Each shaft of the crutches extends upward from a respective one of the connection members to a respective one of the armpit rests. The lower ends of the crutches are free to rotate about their respective fixed points relative to the connection members according to movement of the individual.

In one embodiment, the connection members are defined by a ball invasively implanted in each of the pelvic bones of the individual which extends through the skin layer. A corresponding socket is carried on the lower end of each of the crutches and rotates freely about the ball.

In one embodiment, the back support device also has a pair of hip plates each generally following the contour of the pelvic bone of the individual. The hip plates are stiff and intended to be received over the pelvic bones or hip bulge and carry thereon one of the connection members.

In one embodiment, two straps are included for keeping the two hip plates at a predetermined distance to one another for removably and adjustably securing the hip plates to the pelvic bones.

In one embodiment, the connection members comprise a recessed upward facing socket carried on each of the hip plates. A corresponding ball is carried on the lower end of each crutch and is freely rotatable within the socket.

In one embodiment, the connection members are defined by a ball carried on and extending from each of the hip plates. A corresponding socket is carried on the lower end of each of the crutches whereby the socket rotates freely relative to the ball allowing for full three degrees of relative movement.

These and other objects, features and advantages of the invention will be readily apparent from the following description of the preferred embodiments thereof taken in conjunction with the accompanying drawings. Variation and modifications maybe effected without departing from the scope and spirit of the present invention and the novel concepts of the overall disclosure.

DETAILED DESCRIPTION OF PRESENTLY PREFERRED EMBODIMENTS

Figure 1:
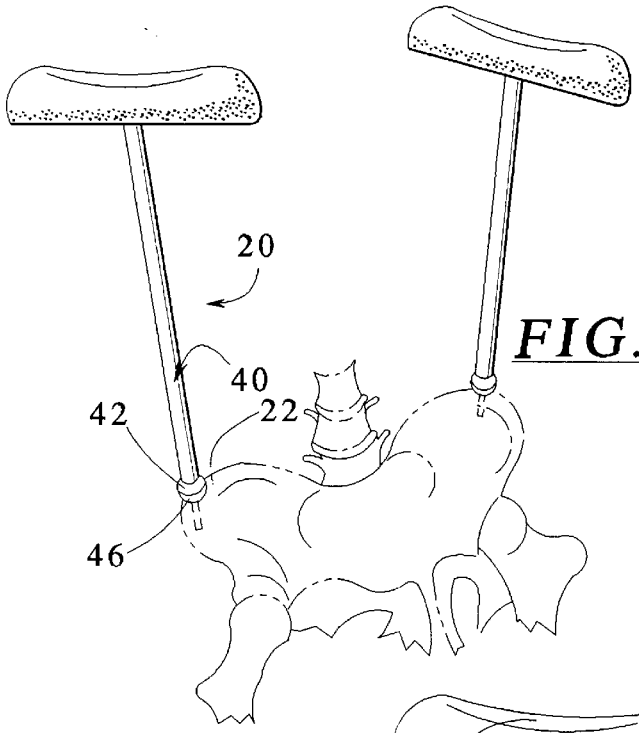
FIG. 1 illustrates a surgically implanted lower back support constructed in accordance with one embodiment of the present invention.

In the embodiment of FIG. 1, a ball 46 is surgically and invasively implanted into an ilium or top of a pelvic bone 22, commonly known as an ossa innominata of an individual whereby the ball protrudes through the skin. This permanent surgically implanted embodiment is intended for individuals with serious lower back injuries or permanent discomfort requiring constant relief.

As described below, the surgical device of FIG. 1 eliminates the need for the hip plates 12 and straps 14, 16 and 17 since the connection or pivot point for the crutches 20 comprises the ball 46 permanently implanted in the patient.

Figure 3:
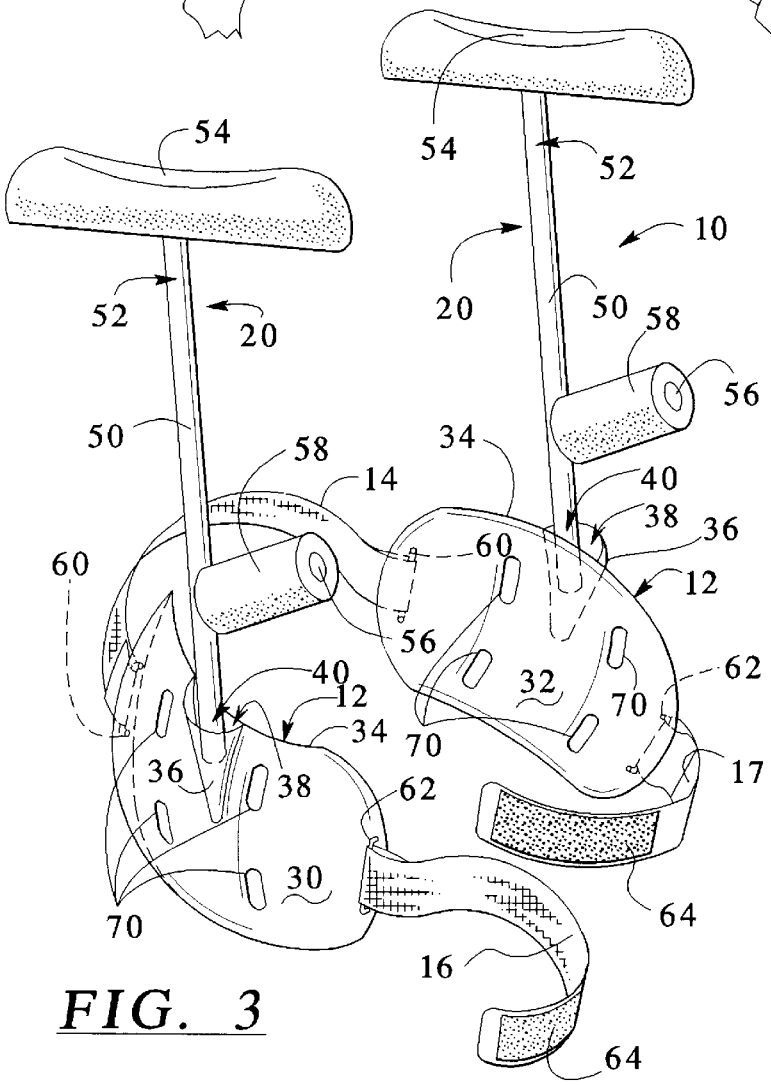
FIG. 3 illustrates a front perspective view of the lower back support shown in FIG. 2.

FIG. 3 illustrates a non-surgical embodiment of a lower back support 10 constructed in accordance with the present invention. The non-surgical lower back support device 10 generally includes a pair of curved hip plates 12 interconnected by a fixed length rear strap 14 and an adjustable front strap 16. The device 10 also includes a pair of crutches 20 one each removably supported by the hip plates 12.

Figure 2:
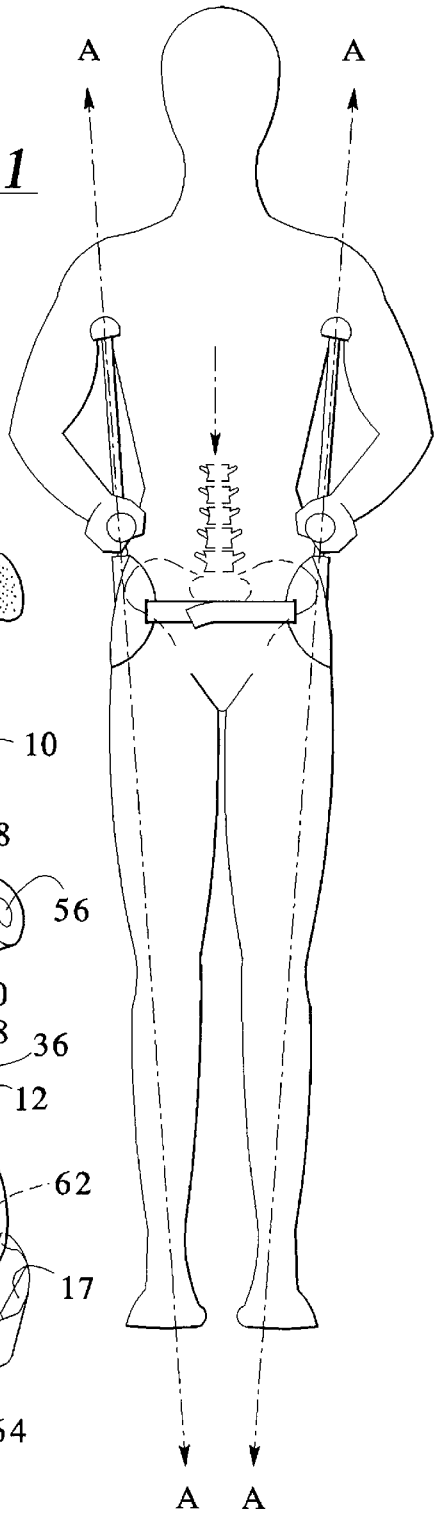
FIG. 2 illustrates a front view of an individual wearing a non-surgical lower back support constructed in accordance with another embodiment of the present invention.

As illustrated in FIG. 2, an individual secures the hip plates 12 around their waist utilizing the straps 14 and 16 so that the plates rest on the ossa innominata or pelvic bones 22. The crutches 20 are installed one each under the arm pits of the individual providing load bearing assistance for an individual's lower back as will be described in more detailed below.

Returning now to FIG. 3, each of hip plates 12 is constructed to generally follow the contour of an individual's hip or pelvic bone. Each hip plate 12 has an exterior surface 30 and an interior surface 32. The interior surface 32 is concave in order to follow the contour of the pelvic bone. Each hip plate 12 also has an upper edge 34 which is intended to curve inwardly over the top or ilium of the pelvic bone to such a degree so as not to cut into an individual's side and yet transfer downward forces into the top or ilium of each pelvic bone. The exterior surface 30 is correspondingly convex and follows the contour of the interior surface 32 in order that the relatively stiff or rigid hip plates 12 have a thin material cross section in order to permit a light weight construction of the plates. Each of the hip plates 12 is curved along both the horizontal axis and a vertical axis so as to provide a secure and comfortable fit against the individual's body.

The hip plates 12 may be constructed from any suitable material but are intended to provide load bearing support for the individual's spine. Therefore the hip plates must be constructed from a relatively rigid material which is preferably also light weight. Stainless steel, aluminum or alloys may be utilized to construct the hip plates without departing from the scope of the invention. Similarly, molded thermoplastic, carbon fiber, or other such compositions may also be utilized to construct the hip plates 12.

Each of the plates 12 also includes a connection member for releasably and pivotably connecting to the crutches 20. In the embodiment illustrated in FIG. 3, the connection member is in the form of a cup or socket 36 having a depression 38 for receiving therein a lower end 40 of the crutches. In this embodiment, the depression 38 may be curved to correspond to a curved lower end 40 of the crutches for mating against the depression 38. The construction of the depression 38 and lower end 40 of the crutches in this embodiment is intended to permit free rotation and pivotal movement of the crutches relative to the sockets 36 both fore and aft and side to side. This construction permits free rotational twist between the ball and the socket as well, thus permitting an individual to twist their upper torso.

In another embodiment, the lower end 40 of the crutch may include a socket attached thereto which is received on a corresponding ball affixed to the exterior surface 30 of the hip plates 12. This ball and socket arrangement permits similar fore and aft and side to side pivotal motion of the crutches 20 relative to the hip plates 12.

In each of the embodiments the crutches 20 include a shaft 50 extending between the lower end 40 and an upper end 52 of the crutches. This shaft must be relatively rigid so that it provides substantial support for the upper torso to relieve stress on the lower back.

Affixed to the upper ends 52 of each crutch 20 is a padded armpit rest 54 for being comfortably received under the arm pit of an individual as illustrated in FIG. 2. These padded armpit rests 54 may take on various constructions and configurations without departing from the scope of the present invention. In one embodiment, these padded rests 54 are similar to those found on conventional walking crutches, but can be custom molded for proper and precise fit.

In one embodiment, each of the crutches 20 also includes a forward protruding hand rest 56 also having a pad 58 thereon. In this alternative embodiment, an individual may grasp the hand rest 56 when wearing the device to temporarily relieve the stress on the shoulders and arm pit area. This is accomplished by pressing down on the hand rest 56 and simultaneously raising the shoulders.

It is intended that the hand rest 56 may take on many configurations and constructions without departing from the scope of the present invention. However, it is desirable that the hand rests 56 be positioned so that they extend forward relative to the crutches 20 so that the individual may easily grasp them with their hands while wearing the device. It is also anticipated that the crutches may alternatively include a structure in place of the hand rest 56 permitting an individual to rest their forearms thereon or place their elbows thereon to temporarily relieve stress and strain on the shoulders and armpit area.

In one embodiment shown in FIG. 3, the hip plates 12 are interconnected at one end by the rear strap 14 which extends from one plate to another for wrapping around the waist and back of an individual. In this embodiment the rear strap 14 is of a fixed length having its opposite ends received one each through an opening in a bracket or guide 60 extending from each of hip plates 12. The ends of the strap 14 are received through the guides 60 and secured in a manner affixing the strap 14 to the plates 12. It is preferred that the rear strap 14 is of a fixed length so the device fits a particular individual precisely each time the individual wears the device. In alternative embodiments, the strap 14 may be adjustable in length in order that a device may be sold in retail outlets as a one size fits all device or at least sold in a range of sizes. The user would adjust the length of the rear strap 14 in order that the hip plates 12 are properly fitted over each of the pelvic bones. By affixing the straps to the guides 60 extending from the outer hip plate surfaces, the inner surfaces touching the person's body remain smooth for maximum comfort.

The device 10 also includes front straps 16 and 17 one each extending from a front edge of a corresponding one of the hip plates 12. The straps 16 and 17 in one embodiment are received through similar brackets or guides 62 formed on the front regions of the hip plates 12. The straps 16 and 17 are fitted with some form of an attachment mechanism for interconnecting the straps in an adjustable and releasable manner around the waist and stomach of the individual. In the embodiment illustrated in FIG. 3, the straps 16 and 17 are fitted with a hook and loop fastener material 64 although other tightening and adjustment mechanisms may be utilized such as conventional buckles. The adjustable straps 16 and 17 permit an individual to comfortably secure the device 10 whether they have just awakened, just finished a large meal, or worn clothing slightly heavier or slightly lighter than another day.

The device 10 may be utilized for many different programs intended to provide care for individuals having lower back pain or discomfort. One such program permits producing a series of hip plates 12 in different sizes along with adjustable rear straps 14 to be sold over the counter. Such devices may fit a variety of sizes of individuals whereby the range of sizes of devices 10 would fit a substantial portion of the population. The crutches 20 may also be produced in a fixed length or a length adjustable manner. The shaft 50 may be produced with one of the lower ends 42 slideable relative to the upper ends 52 either by telescoping over one another, by sliding adjacent to one another or by threading relative to one another. Thus, the crutches may be adaptable to fit patients of varying heights for such a program.

The device 10 is also readily suited for a custom fit or prescription care program where individual patients are premeasured or otherwise sized. The hip plates 12 may be molded cast or formed to precisely fit the contour of the particular individual's hips. The hip plates 12 should have a sufficient surface area to distribute the load from each crutch 20 evenly and comfortably throughout the hip plate. Similarly, the crutches 20, straps 14 and 16, and armpit rests 54 may be produced to exactly fit the individual patient as well. Such a device 10 could be produced or provided to patients through an orthopedic clinic, doctors' facility or hospital facility under a doctor's care. The armpit rests 54 may be produced having a curved profile in order that they are securely held under the individual's arms. The curve allows the rests 54 to "click in" under the armpit securing the crutches 20 in place permitting hands free maneuverability.

The crutches 20 including the shafts 50 and the hand rests 56 are preferably also produced from light-weight rigid and sturdy material such as stainless steel tubing or suitable alloys or from strong, light weight thermoplastics or composites without departing from the scope of the invention. It is intended that the overall device 10 is of a substantially rigid, safe and reliable construction and yet relatively light-weight and compact. The compact size is desired to make the device unnoticeable when worn underneath a layer of clothing. One significant disadvantage of the prior art devices is that they are visually and physically cumbersome. Individuals may chose not to utilize the prior art devices, especially in public, in order to avoid drawing attention to themselves. The device of the present invention is relatively unnoticeable and thus eliminates or reduces any inhibitions an individual may have in wearing the device in public. Similarly, the device provides a relatively free range of motion for the individual so that it may be worn sitting, standing, walking or even running.

To utilize the device, a patient simply places the plates 12 over the pelvic bones 22 so that the connection members 36 are precisely located just above the hip and slightly over the pelvic bone. The individual next attaches the straps 16 and 17 via the fastener such as the hook and loop fastener 64 to a comfortable degree of taughtness around their waist. The individual next places the padded rest 54 of each crutch 20 under their armpits and the lower ends 40 of the crutches onto the connection members 36, or in the case of the permanent implant, on to the ball 46. The degree of support provided by the device 10 may be adjusted simply by the individual raising or lowering their shoulders in a shrugging motion. Each of the crutches 20 acts as a rigid column or load bearing device taking a load off of the individual's spine providing a "three" spine configuration.

To achieve the most satisfactory results, it is desired that the force trajectory between the padded rest 54 and the connection between the lower ends 40 and the connection members 36 or 46 is co-linear with a line extending along—thereat the crutches 20 through the ilium of each pelvic bone to the balls of the persons feet both in a front view as shown in FIG. 2 as line "A" and in the side view (not shown). Such placement and orientation of the crutches 20 provides the most adequate relief for the individual. This force vector is to transmit loads into the ilia of the pelvic bone as is clearly illustrated in FIGS. 1 and 2. Thus, placement of the connection members 36 or 46 is essential in properly aligning the crutches 20 relative to the vector line between the individual's shoulders and the balls of their feet.

The hip plates may include vents 70 or be suitably perforated as shown for example in the plates of FIG. 3. The vents will permit an individual to wear the device 10 all day and yet remain comfortable.

It should be understood that various changes and modifications to the presently preferred embodiments which are described herein will be apparent to those skilled in the art. Such changes and modifications may be made without departing from the scope and spirit of the present invention and without diminishing its attendant advantages. It is therefore intended that such changes and modifications be covered by or within the scope of the appended claims.

What is claimed is:

1. A back support device for an individual with a pair of ossa innominata pelvic bones each having an ilium, the back support device comprising:

a pair of crutches each having a shaft with a lower end, an upper end, and an armpit rest carried on the upper end;

a pair of connection joints that each transmit a load applied from the upper end to the lower end of a respective one of the crutches generally downward into their respective ilium, support and retain the lower end at a corresponding fixed point disposed above a respective one of the ilia, end to move in three rotational degrees of freedom about the corresponding fixed point according to movement of the individual, and permit uninhibited separation of the lower end from the connection joint upon immediate release of the load; and a pair of hip plates each having a three dimensional curved shape for being received over one of the os innominatum pelvic bones, each hip plate having an inner surface with a surface area that contacts the individual and distributes the load over a majority of the surface area, and a curved upper edge adapted to extend at least partly over a respective one of the ilia and carry at least a portion of a respective one of the connection joints.

2. The back support of claim 1, further comprising: a strap for wrapping around the individual, the strap connecting the two plates to one another for removably and adjustably securing the hip plates adjacent the ossa innominata pelvic bones.

3. The back support of claim 1, further comprising:

a fixed length rear strap interconnecting the pair of hip plates for wrapping around a back of the individual and a length adjustable front strap interconnecting the pair of hip plates for wrapping around a front of the individual, the straps for removably and adjustably securing the hip plates adjacent the ossa innominata pelvic bones.

4. The back support of claim 1 wherein the hip plates are made of a metal.

5. The back support of claim 1 wherein the hip plates are made of a relatively strong composite plastic material.

6. The back support of claim 1, further comprising:

a fixed length rear strap interconnecting the pair of hip plates for wrapping around a back of the individual;

a front strap for wrapping around a front of the individual, the front strap having two strap sections connected one each to the pair of hip plates; and a hook and loop fastener carried by the front strap for securing the two strap sections to one another.

7. The back support of claim 1, further comprising:

a recessed upward facing socket carried on each of the hip plates defining the connection joints and a corresponding ball carried on the lower end of each crutch.

8. The back support of claim 1, further comprising:

a curved armpit rest on the upper end of each crutch for conforming to each armpit of the individual to securely retain each crutch in place.

9. The back support of claim 1, wherein each shaft is made from a material selected from one of a group comprising at least stainless steel, aluminum and composite plastic.

10. The back support of claim 1, further comprising:

a soft pad received over the armpit rest of each crutch.

11. The back support of claim 1, wherein the crutches are made from a molded thermoplastic material.

12. The back support of claim 1, further comprising:

a hand rest extending at an angle relative to and forward from the shaft of each crutch.

13. The back support of claim 1, further comprising:

a recessed downward facing socket on the lower end of each crutch and a corresponding ball extending from each hip plate defining the connection joints.

14. A back support device for an individual with a pair of ossa innominata pelvic bones each having an ilium, the back support device comprising:

a pair of crutches each having a shaft with a lower end, an upper end, and an armpit rest carried on the upper end;

a pair of pins each having one end adapted for being implanted and extending downward into a respective ilium of the ossa innominata pelvic bones of the individual and a ball carried on an opposite end of each pin; and a corresponding socket carried on the lower end of each crutch whereby each of the balls is received in a corresponding one of the sockets to permit each crutch to move three dimensionally about the corresponding ball and to be freely separable from the corresponding ball.

15. A back support device for an individual with a pair of ossa innominata pelvic bones each having an ilium, the back support device comprising:

a pair of crutches each having a shaft with a lower end, an upper end, and an armpit rest carried on the upper end;

a pair of pins each having one end adapted to be implanted into a respective ilium, each pin defining a connection joint that transmits a load applied from the upper end to the lower end of one of the crutches generally downward into the respective ilium, that supports and retains the lower end of one of the crutches by the load at a corresponding fixed point disposed above the respective ilia, that permits the lower end of one of the crutches to move three dimensionally about the corresponding fixed point according to movement of the individual, and that permits uninhibited separation of the respective crutch from the connection joint upon removal of the load.

16. The back support of claim 15, further comprising:

a curved armpit rest on the upper and of each crutch for conforming to each armpit of the individual to securely retain each crutch in place.

17. The back support of claim 15, wherein each shaft is made from a material selected from one of a group comprising at least stainless steel, aluminum and composite plastic.

18. The back support of claim 15, further comprising:

a ball extending from an opposite end of each of the pins defining the connection joints; and a recessed downward facing socket carried on the lower end of each crutch corresponding to a respective one of the balls.

19. The back support of claim 15, further comprising:

a soft pad received over the armpit rest of each crutch.

20. The back support of claim 15, wherein each crutch is made from a molded thermoplastic material.

21. The back support of claim 15, further comprising:

a hand rest extending at an angle relative to and forward from the shaft of each crutch.

* * * * *